US010250962B2

(12) United States Patent
Zheng

(10) Patent No.: US 10,250,962 B2
(45) Date of Patent: Apr. 2, 2019

(54) PACKAGE STRUCTURE OF MEMS MICROPHONE

(71) Applicant: GOERTEK.INC, Weifang, Shandong (CN)

(72) Inventor: Guoguang Zheng, Weifang (CN)

(73) Assignee: GOERTEK.INC, Weifang, Shandong (CN)

( * ) Notice: Subject to any disclaimer, the term of this patent is extended or adjusted under 35 U.S.C. 154(b) by 0 days.

(21) Appl. No.: 15/554,980

(22) PCT Filed: Dec. 10, 2015

(86) PCT No.: PCT/CN2015/096912

§ 371 (c)(1),
(2) Date: Aug. 31, 2017

(87) PCT Pub. No.: WO2016/176993

PCT Pub. Date: Nov. 10, 2016

(65) Prior Publication Data

US 2018/0048951 A1 Feb. 15, 2018

(30) Foreign Application Priority Data

May 6, 2015 (CN) ..... 2015 1 0227109

(51) Int. Cl.
*H04R 1/04* (2006.01)
*H04R 19/00* (2006.01)
(Continued)

(52) U.S. Cl.
CPC ..... *H04R 1/04* (2013.01); *H04R 19/005* (2013.01); *H04R 19/04* (2013.01); *H04R 31/00* (2013.01); *H04R 2201/003* (2013.01)

(58) Field of Classification Search
CPC ..... H04R 19/005; H04R 19/04; H04R 2201/003; H04R 1/04; H04R 2499/11;
(Continued)

(56) References Cited

U.S. PATENT DOCUMENTS

2003/0076970 A1* 4/2003 van Halteren ..... H04R 1/04 381/191
2006/0096183 A1* 5/2006 Yamaguchi ..... B32B 7/00 52/144
(Continued)

FOREIGN PATENT DOCUMENTS

CN 102332259 A * 1/2012
CN 102332259 A * 1/2012

*Primary Examiner* — Curtis A Kuntz
*Assistant Examiner* — Julie X Dang
(74) *Attorney, Agent, or Firm* — Ladas & Parry LLP; Loren K. Thompson

(57) ABSTRACT

The present invention discloses a package structure of a MEMS microphone. The package structure comprises a closed inner cavity formed by a package shell in a surrounding manner, as well as a MEMS chip and an ASIC chip which are located in the closed inner cavity, wherein a sound hole allowing sound to flow into the closed inner cavity is formed in the package shell; the MEMS chip comprises a substrate as well as a vibrating diaphragm and a back plate which are provided on the substrate; the vibrating diaphragm divides the closed inner cavity into a front cavity and a back cavity; and a sound-absorbing structure is provided in the back cavity.

7 Claims, 3 Drawing Sheets

(51) Int. Cl.
*H04R 19/04* (2006.01)
*H04R 31/00* (2006.01)

(58) Field of Classification Search
CPC ..... H04R 31/00; H04R 31/006; H04R 1/086; H04R 1/023; H04R 3/005; H04R 1/38; H04R 1/06
USPC ..... 381/174, 361, 175, 113, 111, 355, 114
See application file for complete search history.

(56) References Cited

U.S. PATENT DOCUMENTS

2011/0038495 A1* 2/2011 Jeong ..... H04R 17/00 381/190
2011/0198714 A1* 8/2011 Yang ..... B81B 7/0061 257/416
2015/0158722 A1* 6/2015 Lim ..... B81B 7/02 257/416

* cited by examiner

PACKAGE STRUCTURE OF MEMS MICROPHONE

CROSS REFERENCE TO RELATED APPLICATION

This application is a national stage application, filed under 35 U.S.C. § 371, of International Application No. PCT/CN2015/096912, filed on Dec. 10, 2015, which claims priorities to Chinese Application No. 201510227109.3 filed on May 6, 2015, the content of which is hereby incorporated by reference in its entirety.

FIELD OF THE INVENTION

The present invention relates to the field of acoustic-electric conversion, and relates to a microphone, and more particularly, to a package structure of a MEMS (Micro-electromechanical System) microphone.

BACKGROUND OF THE INVENTION

MEMS (Micro-electromechanical System) microphones are manufactured based on the MEMS technology. In a MEMS microphone, a vibrating diaphragm and a back plate are important components which constitute a capacitor and are integrated on a silicon wafer, so as to realize acoustic-electric conversion.

A package structure of the MEMS microphone is shown in FIG. 1. A MEMS chip 3 and an ASIC (Application Specific Integrated Circuit) chip 2 are surface-mounted on a package substrate 1, and connected via wire bonding, and then a package housing 4 with a sound hole 40 is surface-mounted on the package substrate 1 to form a front cavity of the MEMS microphone. The MEMS chip 3 comprises a substrate 33 as well as a back plate 32, a vibrating diaphragm 30 and the like which are arranged on the substrate 33; and the back plate 32 and the vibrating diaphragm 30 form a capacitor structure for acoustic-electric conversion. The vibrating diaphragm 30, the substrate 33 and the package substrate 1 together form a back cavity of the MEMS microphone. In order to ensure air pressure balance between a front cavity and a back cavity of the MEMS microphone, a plurality of air guide holes 31 is formed in the vibrating diaphragm 30 to realize smooth flow of air between the front and back cavities.

FIG. 2 shows a transmitting path of sound waves in the MEMS microphone. First, incident sound wave enter into a front cavity of the MEMS microphone through the sound hole 40 in the package shell and reach the vibrating diaphragm of the MEMS microphone, so that the vibrating diaphragm thereof vibrates up and down, thereby realizing detection of the sound wave. Most of the sound wave that directly reach the vibrating diaphragm of the MEMS microphone are configured to cause the vibrating diaphragm to vibrate, but a small part of the direct sound wave will pass through the air guide holes in the vibrating diaphragm of the MEMS microphone to enter into the back cavity. As the package substrate is rigid, the sound wave will be reflected and act on the vibrating diaphragm again. The direction of vibrating diaphragm displacement caused by these reflected sound waves is opposite to that of vibrating diaphragm displacement caused by the direct sound waves, offsetting partial displacement caused by the direct sound wave, and reducing sensitivity of the vibrating diaphragm of the MEMS microphone. Moreover, there is a time difference between the direct sound wave acting on a front surface of the vibrating diaphragm and the reflected sound wave acting on a back surface of the vibrating diaphragm. That is, phases are different, which is the same as noise, affecting a signal-to-noise ratio of an output signal.

Therefore, there is a demand in the art that a new solution for a package structure of a MEMS (Micro-electromechanical System) microphone shall be proposed to address at least one of the problems in the prior art.

SUMMARY OF THE INVENTION

An object of the present invention is to provide a new technical solution of a package structure of a MEMS microphone.

According to a first aspect of the present invention, there is provided a package structure of a MEMS microphone. The package structure comprises a closed inner cavity formed by a package shell in a surrounding manner, as well as a MEMS chip and an ASIC chip which are located in the closed inner cavity, wherein a sound hole allowing sound to flow into the closed inner cavity is formed in the package shell; the MEMS chip comprises a substrate as well as a vibrating diaphragm and a back plate which are provided on the substrate; the vibrating diaphragm divides the closed inner cavity into a front cavity and a back cavity; and a sound-absorbing structure is provided in the back cavity.

Alternatively or optionally, the package shell comprises a package substrate and a package housing arranged on the package substrate; the MEMS chip is mounted on the package substrate through its substrate; and the vibrating diaphragm, the substrate and the package substrate together form the back cavity in a surrounding manner.

Alternatively or optionally, the sound-absorbing structure is provided on the package substrate.

Alternatively or optionally, package substrate is provided with a groove in which the sound-absorbing structure is arranged.

Alternatively or optionally, the sound-absorbing structure is arranged on a side wall of the substrate.

Alternatively or optionally, the sound-absorbing structure is a sound-absorbing film layer.

Alternatively or optionally, the sound-absorbing film layer is made of polyimide.

Alternatively or optionally, the sound-absorbing structure is of a microplate structure.

Alternatively or optionally, the microplate structure comprises at least two layers of microporous sound-absorbing plates laminated together.

Alternatively or optionally, micropores in the at least two layers of microporous sound-absorbing plates are distributed in a staggered manner.

In the package structure of the MEMS microphone provided by the present invention, incident sound waves enter into the front cavity of the MEMS microphone from the sound hole in the package shell; most of the sound waves that directly reach the vibrating diaphragm are configured to cause the vibrating diaphragm to vibrate, but a small part of the direct sound waves will pass through the air guide holes in the vibrating diaphragm to enter into the back cavity, and are absorbed by the sound-absorbing structure located in the back cavity, so that these sound waves cannot be reflected, thereby eliminating the influence of the reflected sound waves on the vibrating diaphragm in the back cavity, and improving sensitivity and a signal-to-noise ratio of the MEMS microphone.

The inventor of the present invention has found that in the prior art, sound waves incident into the back cavity will be reflected and the reflected sound waves will act on the back surface of the vibrating diaphragm again, reducing the sensitivity of the vibrating diaphragm of the MEMS microphone, and affecting the signal-to-noise ratio of the output signal. Therefore, the technical task to be achieved or the technical problem to be solved by the present invention is unintentional or unanticipated for those skilled in the art, and thus the present invention refers to a novel technical solution.

Further features of the present invention and advantages thereof will become apparent from the following detailed description of exemplary embodiments according to the present invention with reference to the attached drawings.

BRIEF DESCRIPTION OF THE DRAWINGS

The accompanying drawings, which are incorporated in and constitute a part of the specification, illustrate embodiments of the invention and, together with the description thereof, serve to explain the principles of the invention.

DETAILED DESCRIPTION OF THE EMBODIMENTS

Figure 1:
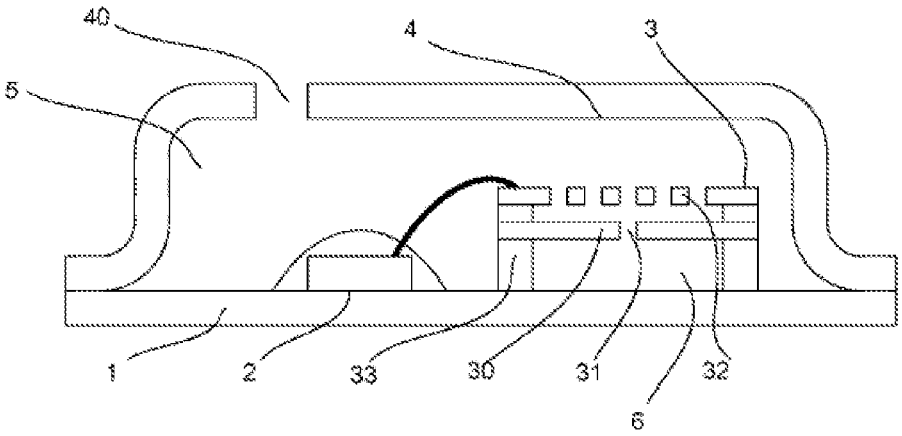
FIG. 1 is a schematic diagram of a package structure in the prior art.
Figure 2:
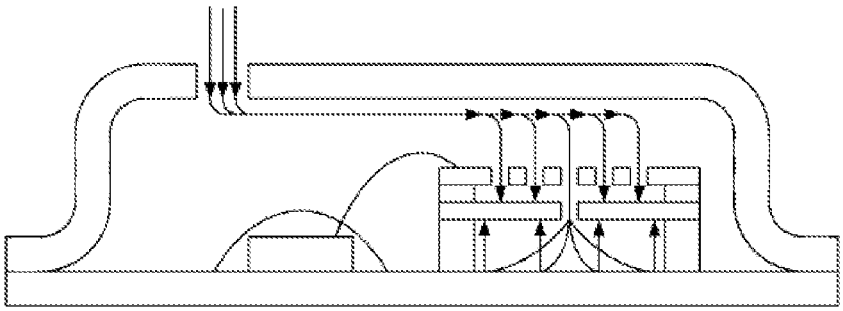
FIG. 2 shows a transmitting path of sound waves in the package structure shown in FIG. 1.

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

Figure 3:
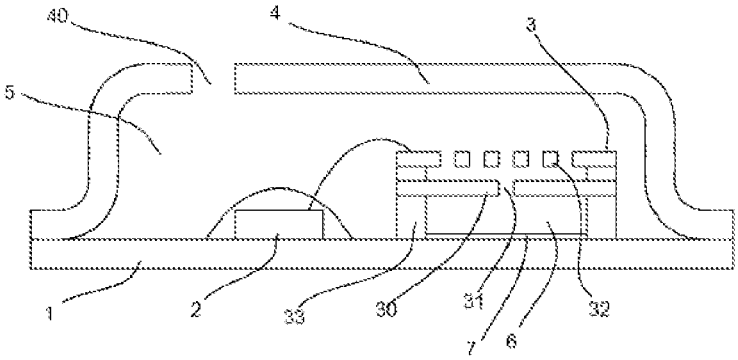
FIG. 3 is a schematic diagram of a package structure provided by the present invention.

Referring to FIG. 3, there is a package structure of a MEMS microphone provided by the present invention. The package structure comprises a closed inner cavity formed by a package shell in a surrounding manner. In a detailed embodiment of the present invention, the package shell comprises a package substrate 1 and a package housing 4 with a sound hole 40, wherein the package housing 4 is mounted with the package substrate 1 to form the closed inner cavity of the MEMS microphone. The package housing 4 can be in the form of a flat plate. Here, it is also necessary to provide a side wall portion to support the package housing 4 on the package substrate 1 to together form external package of a microphone.

The package structure further comprises a MEMS chip 3 and an ASIC chip 2 which are located in the closed inner cavity. The MEMS chip 3 is a transduction component for converting a sound signal into an electric signal, and is manufactured based on a MEMS process. The MEMS chip 3 comprises a substrate 33 as well as a vibrating diaphragm 30, a back plate 32 and other components which are provided on the substrate 33. There is a certain distance between the vibrating diaphragm 30 and the back plate 32, so that a capacitor structure is formed therebetween. Through its substrate 33, the MEMS chip 3 may be mounted on the package substrate 1. Here, the vibrating diaphragm 30 divides the closed inner cavity into a front cavity 5 and a back cavity 6; and the back cavity 6 is formed by the vibrating diaphragm 30, the substrate 33 and the package substrate 1 together in a surrounding manner. In another embodiment of the present invention, a sound hole 40 may be provided on the package substrate 1, and located at a position corresponding to the vibrating diaphragm 30 in the MEMS chip 3. In this case, the back cavity 6 is formed by the vibrating diaphragm 30 and the package housing 4 in a surrounding manner. That is, the back cavity 6 is determined based on the position of the sound hole 40; the side, adjacent to the sound hole 40, of the vibrating diaphragm 30 is the front cavity; and the side, away from the sound hole 40, of the vibrating diaphragm is the back cavity. These are common technical means for those skilled in the art, so that detailed description thereof is omitted herein.

After being incident onto the vibrating diaphragm 30, external sound waves drive the vibrating diaphragm 30 to vibrate up and down, so as to realize detection of the sound waves. In order to ensure air pressure balance between the front cavity 5 and the back cavity 6 of the MEMS microphone, a plurality of air guide holes 31 is formed in the vibrating diaphragm 30 to realize smooth flow of air between the front cavity 5 and the back cavity 6.

The ASIC chip 2 in the present invention is a signal amplifier which is mainly configured to amplify an electric signal output from the MEMS chip 3 for processing easily in subsequent. In the present invention, the MEMS chip 3 and the ASIC chip 2 may be arranged on the package substrate 1. Of course, for those skilled in the art, the MEMS chip and the ASIC chip may also be arranged on the package housing 4, which will not be described in detail herein.

Figure 5:
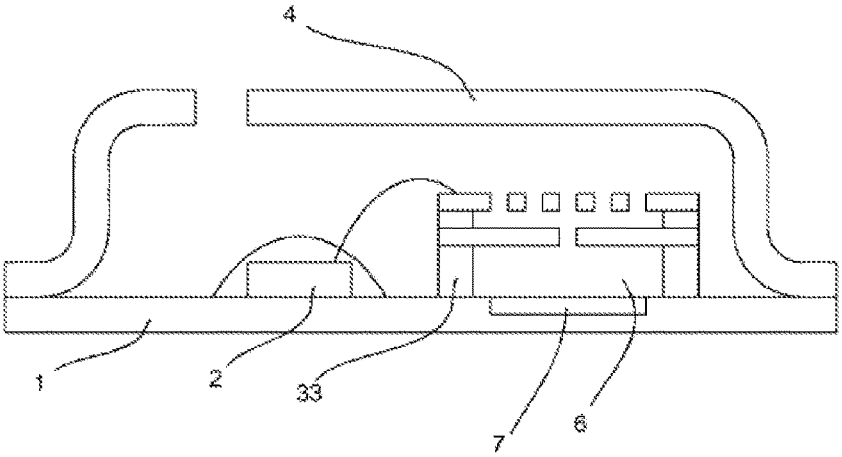
FIG. 5 is a schematic diagram of a package structure according to another embodiment of the present invention.

In the package structure provided by the present invention, a sound-absorbing structure is provided in the back cavity 6. In a detailed embodiment of the present invention, the sound-absorbing structure may be a sound-absorbing film layer 7 which may be made of sound-absorbing material well known to those skilled in the art, such as sound-absorbing cotton, polyimide, other soft organic materials, or the like. The sound-absorbing film layer 7 may be arranged in the back cavity 6 by coating or other manners well known to those skilled in the art. Referring to FIG. 3, the back cavity 6 is formed by the vibrating diaphragm 30, the substrate 33 and the package substrate 1 in a surrounding manner. Here, the sound-absorbing film layer 7 may be coated on the surface of package substrate 1 corresponding the back cavity 6. Preferably, referring to FIG. 5, a groove is formed in the package substrate 1, and the sound-absorbing film layer 7 is arranged in the groove. During manufacturing, a groove may be etched in the package substrate 1, and then the sound-absorbing film layer 7 may be deposited in the groove, so that the thickness of the sound-absorbing film layer 7 may be increased to improve sound-absorbing effect, without reducing the size of the back cavity 6. Of course, the sound-absorbing film layer 7 may also be arranged on the side wall of the substrate 33 simultaneously or separately.

Figure 4:
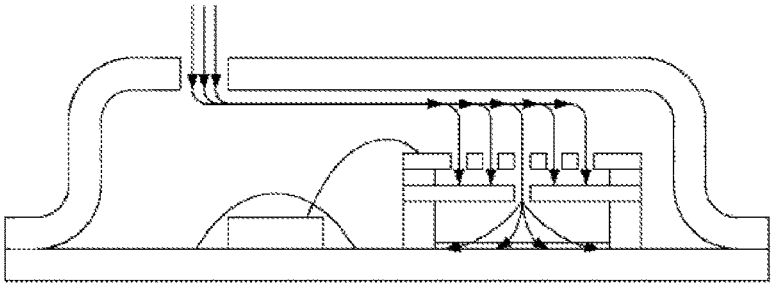
FIG. 4 shows a transmitting path of sound waves in the package structure shown in FIG. 3.
Figure 7:
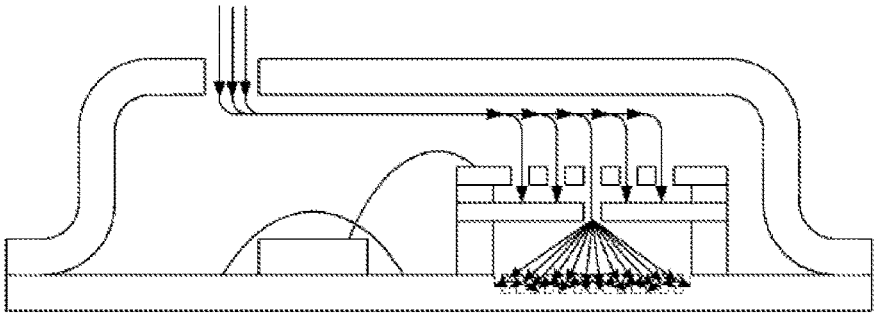
FIG. 7 shows a transmitting path of sound waves in the package structure shown in FIG. 6.

FIG. 4 shows a transmitting path of sound waves in the MEMS microphone. The incident sound waves enter into the front cavity of the MEMS microphone from the sound hole in the package shell. Most of the sound waves that directly reach the vibrating diaphragm are configured to cause the vibrating diaphragm to vibrate, but a small part of the direct sound waves will pass through the air guide holes in the vibrating diaphragm to enter into the back cavity of the MEMS microphone, and are absorbed by the sound-absorbing structure located in the back cavity, so that these sound waves cannot be reflected, thereby eliminating the influence of the reflected sound waves on the vibrating diaphragm in the back cavity, and improving the sensitivity and the signal-to-noise ratio of the MEMS microphone In another embodiment of the present invention, the sound-absorbing structure is a microplate structure 8. Referring to FIG. 7, after being incident onto the microplate structure 8, the sound waves will be repeatedly reflected, and only a small part of sound waves can be reflected out of the back cavity, thereby greatly reducing the intensity of the reflected sound waves in the back cavity.

Figure 6:
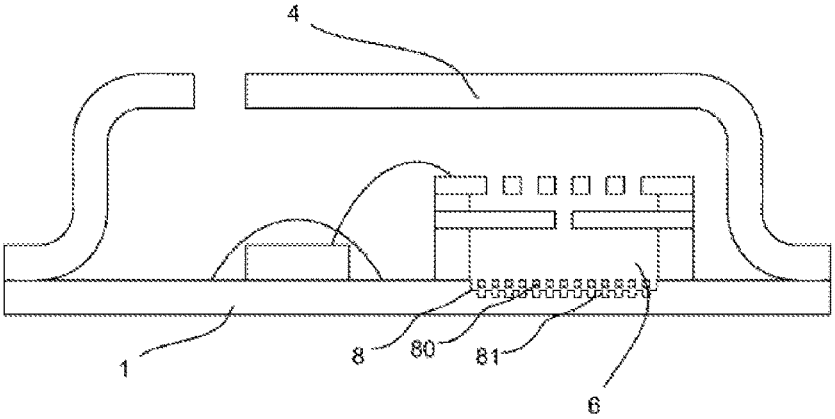
FIG. 6 is a schematic diagram of a package structure according to yet another embodiment of the present invention.

In a detailed embodiment of the present invention, the microplate structure 8 comprises at least two layers of microporous sound-absorbing plates laminated together. Referring to FIG. 6, for description, an example in which two layers of microporous sound-absorbing plates are arranged is taken. The two layers of microporous sound-absorbing plates are respectively marked as a first microporous sound-absorbing plate 80 and a second microporous sound-absorbing plate 81 which are laminated together. Micropores of the two layers of microporous sound-absorbing plates may be arranged face to face or in a staggered manner, so that the intensity of emitted sound waves can be further reduced. The two microporous sound-absorbing plates (80 and 81) may be formed in the structure of the package substrate 1. For example, when the package substrate 1 is manufactured by a laminating process, the micropores are pre-punched at corresponding positions on the two plates, and then the two plates are laminated in the package substrate 1.

Although some specific embodiments of the present invention have been demonstrated in detail with examples, it should be understood by a person skilled in the art that the above examples are only intended to be illustrative but not to limit the scope of the present invention.

What is claimed is:

1. A package structure of a MEMS microphone, the package structure comprising a closed inner cavity formed by a package shell, as well as a MEMS chip and an ASIC chip which are located in the closed inner cavity, wherein a sound hole allowing sound to flow into the closed inner cavity is formed on the package shell; the MEMS chip comprises a substrate as well as a vibrating diaphragm and a back plate which are provided on the substrate; the vibrating diaphragm are provided with a plurality of air guide holes and divides the closed inner cavity into a front cavity and a back cavity; and a sound-absorbing structure is provided in the back cavity, wherein the package shell comprises a package substrate and a package housing provided on the package substrate; the MEMS chip is mounted on the package substrate through its substrate; and the vibrating diaphragm, the substrate and the package substrate together form the back cavity in a surrounding manner, and the package substrate is provided with a groove in which the sound-absorbing structure is arranged.

2. The package structure according to claim 1, wherein the sound-absorbing structure is arranged on a side wall of the substrate.

3. The package structure according to claim 2, wherein the sound-absorbing structure is a sound-absorbing film layer.

4. The package structure according to claim 3, wherein the sound-absorbing film layer is made of polyimide.

5. The package structure according to claim 2, wherein the sound-absorbing structure is of a microplate structure.

6. The package structure according to claim 5, wherein the microplate structure (8) comprises at least two layers of microporous sound-absorbing plates laminated together.

7. The package structure according to claim 6, wherein micropores on the at least two layers of microporous sound-absorbing plates are distributed in a staggered manner.

* * * * *